United States Patent [19]

Novy

[11] Patent Number: 4,901,698

[45] Date of Patent: Feb. 20, 1990

[54] EMISSION CONTROL SYSTEM

[75] Inventor: Vladimir A. Novy, Alhambra, Calif.

[73] Assignee: Los Angeles County Sanitation District, Whittier, Calif.

[21] Appl. No.: 304,386

[22] Filed: Jan. 30, 1989

Related U.S. Application Data

[62] Division of Ser. No. 99,566, Sep. 22, 1987, Pat. No. 4,825,843.

[51] Int. Cl.[4] ..... F02P 5/06

[52] U.S. Cl. ..... 123/418; 123/525; 73/116

[58] Field of Search ..... 123/418, 420, 440; 73/118

[56] References Cited

U.S. PATENT DOCUMENTS

| | | | |
|---|---|---|---|
| 2,729,205 | 1/1956 | Nichols . | |
| 4,104,989 | 8/1978 | Resler, Jr. | 123/430 |
| 4,135,481 | 1/1979 | Resler, Jr. | 123/568 |
| 4,196,701 | 4/1980 | Tamura et al. | 123/188 M |
| 4,302,815 | 11/1981 | Tedeschi et al. | 123/440 |
| 4,399,789 | 8/1983 | Yano | 123/418 |
| 4,403,584 | 9/1983 | Suzuki et al. | 123/418 |
| 4,413,593 | 11/1983 | Resler, Jr. | 123/1 A |
| 4,453,502 | 6/1984 | Resler, Jr. | 123/1 A |
| 4,732,117 | 3/1988 | Tanahashi et al. | 123/65 PE |

OTHER PUBLICATIONS

John H. Seinfeld, Air Pollution, McGraw-Hill, Inc. (1975), pp. 358–359, 364–365 and 374–375.

*Primary Examiner*—E. Rollins Cross

*Attorney, Agent, or Firm*—Nilsson, Robbins, Dalgarn, Berliner, Carson & Wurst

[57] ABSTRACT

A method is provided for the control of nitrogen oxide and carbon monoxide emissions from a digester gas engine by the injection of air immediately upstream of the intake valve to form a gradient charge in the combustion chamber having an incombustible portion adjacent the piston and a more concentrated combustible portion adjacent the spark plug, and by the calibration of the spark advance curve of the engine.

16 Claims, 3 Drawing Sheets

EMISSION CONTROL SYSTEM

FIELD OF THE INVENTION

This is a division of application Ser. No. 099,566 filed Sept. 22, 1987, now U.S. Pat. No. 4,825,843.

This invention relates to the field of internal combustion engines, and more particularly to a method of controlling emissions in the exhaust gas of spark-ignition, Otto cycle internal combustion engines.

BACKGROUND AND SUMMARY OF THE INVENTION

Otto cycle internal combustion engines have long been a source of exhaust-gas emissions which are considered to be deleterious in the atmosphere. Accordingly, various governmental agencies have imposed severe limitations on the amount of pollutants, such as nitrogen oxides and carbon monoxide, which may be emitted by such engines. In particular, large displacement gaseous fuel engines are subject to stringent governmental control due, in part, to the type of fuel which is often ingested by such power plants.

Many industries use stationary engines of large displacement to operate pumps, generators, compressors and so forth. For example, gaseous-fueled engines are commonly found in sewage treatment plants and comprise large, stationary Otto cycle internal combustion engines which are fueled by digester gases and used to operate pumps for sewage and the like.

For example, organic solids reduction process may involve the anaerobic digestion of solid waste and water, or sewage sludge slurry, over a number of days to produce a methane-rich gas. Bioreactor gas is prepared from solid waste by shredding and air classification, followed by blending with water to produce a mixture of 10–20% solids concentration. Digester gas is produced from a slurry which is heated and placed in a mixed digester at about 33° C. for ten to fifteen days, and the digester gas is withdrawn from this mixture. The bioreactor gases primarily contain methane, carbon dioxide and ammonia. Digester gas contains methane, carbon dioxide and traces of other gases. These gases are mixed with air prior to combustion, and form significant amounts of nitrogen oxide and carbon monoxide which are subject to stringent emissions control.

The basic principle of the invention is to provide an apparatus and method for the injection of air into the intake port, directly upstream from the intake valve, to form a quantity of air or lean air/fuel mixture at the intake valve in a manner such that when the valve is subsequently opened, the quantity of air partially fills the cylinder during the suction stroke to define a portion of an incombustible lean mixture adjacent the piston with the remaining portion of the cylinder adjacent the spark plug being filled with a gradually more concentrated (i.e., combustible) fuel-air mixture. This method of air injection has surprisingly been found to significantly reduce carbon monoxide emissions in digester gas engines, particularly at lower engine speeds, i.e., 200 to 260 RPM. In addition, the air-fuel ratio setting is modified to reduce nitrogen oxide formation and the engine spark timing is varied over the operating range of the engine which further reduces nitrogen oxygen formation. This relationship is determined by calibrating the engine. The information obtained with respect to the spark timing is used to prepare a preprogrammed timing device to produce the desired spark angle for any given engine speed. A particularly advantageous spark advance curve is programmed to include a spark advance which increases monotonically from about 15.2 to 16 degrees at 200 RPM, about 17.0 to 17.2 degrees at 240 RPM, about 18.4 to 19 degrees at 280 RPM, and to about 19 to 19.5 degrees at 300 RPM. By this apparatus and method, the engine exhaust gas for a digester gas engine is in full compliance with the most stringent regulations for nitrogen oxide and carbon monoxide emissions.

More particularly, an apparatus and method are provided for controlling engine exhaust emissions in the exhaust gas of a spark-ignition Otto cycle internal combustion engine which includes permitting air to be injected into the intake port of the engine immediately prior to the intake valve in a manner by which a substantial portion of the intake manifold adjacent to and upstream from the intake valve is filled with air while the intake valve is closed, and this air is drawn into the combustion chamber by the intake stroke of the associated piston so that the gas which ultimately fills the chamber has a gradient of fuel concentration with a portion nearest the piston consisting essentially of air and the portion nearest the spark-ignition means consisting essentially of the fuel-air mixture which is drawn from the intake manifold upstream from the air-containing portion. The method further includes initially operating the engine without air injection and retarding the spark timing means from optimal tuning angle; regulating the air-fuel mixing means and thus the ratio of the air-fuel mixture which is drawn into the combustion chamber to achieve an oxygen level in the exhaust gas of from about 1.5 to about 1.7% by volume; opening the inlet air control means and admitting air to the intake port to lower the emissions in the exhaust gas without lowering the engine speed; setting the engine to operate at a given speed within the operating range, adjusting the spark timing means and recording the spark angle necessary to obtain the minimum emissions for a given RPM; repeating the setting, adjusting and recording steps over a plurality of engine operating speeds and determining a spark timing curve for minimum emissions over the operating range of the engine; and using the determined spark timing curve to program the spark timing means so that minimum nitrogen oxide emissions over the operating range of the engine is obtained.

Broadly, the invention comprises creating a gradient of fuel concentration in the cylinder (i.e., a stratified charge having an infinite number of strata), the charge having an incombustible fuel-lean portion next to the piston and a relatively fuel-rich portion next to the spark plug in the combustion chamber, and preprogramming the spark timing means to produce a spark advance to further minimize the emissions for the operating speed of an Otto cycle engine. The invention is particularly advantageous when employed with a gaseous fuel engine such as a digester gas engine.

DETAILED DESCRIPTION OF THE PREFERRED EMBODIMENT

The invention is applicable to a wide range of gaseous fuel (i.e., LPG or natural gas) internal combustion engines, but the results are most easily demonstrable on digester gas engines due to the particular fuel employed. Large displacement, gaseous fueled stationary internal combustion engines, for example, those designed to operate on natural gas fuel, are produced by a number of heavy equipment manufacturers. These natural gas engines are adapted to burn digester gas by the manufacturers by changing the air-fuel mixing valve to accommodate digester gas. In the described embodiment, an Ingersoll-Rand PKVG-10 ten-cylinder engine is adapted and operated according to the invention. This engine has ten cylinders, each having a 15¼ inch bore, a stroke of 18 inches and a compression ratio of 8 to 1. It will be apparent that such large engines, having displacements in excess of 10,000 cubic inches, provide significant problems in air pollution and in methods for air pollution control.

Figure 3:
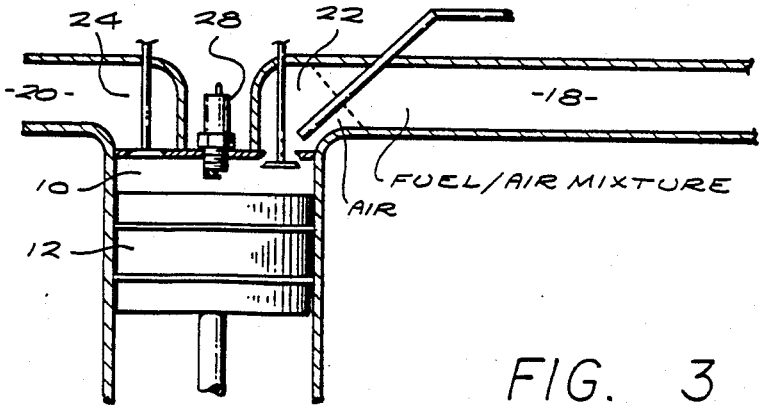
FIG. 3 is a schematic view, partially in section, of the combustion chamber of an engine showing the stratification means of the present invention.

Referring to the figures, an internal combustion engine is shown which includes a plurality of cylinders 10 in each of which is reciprocally mounted a piston illustrated in FIG. 3 by the reference numeral 12. Associated with each cylinder are conventional intake and exhaust valves 14 and 16, respectively, and intake and exhaust manifold portions 18 and 20 which communicate at one end with intake and exhaust ports 22 and 24. The ports 22 and 24 may also be defined as valve chambers in that they comprise an area from the valve extending upstream or downstream, respectively, having a volume which is hereinafter described.

Figure 2:
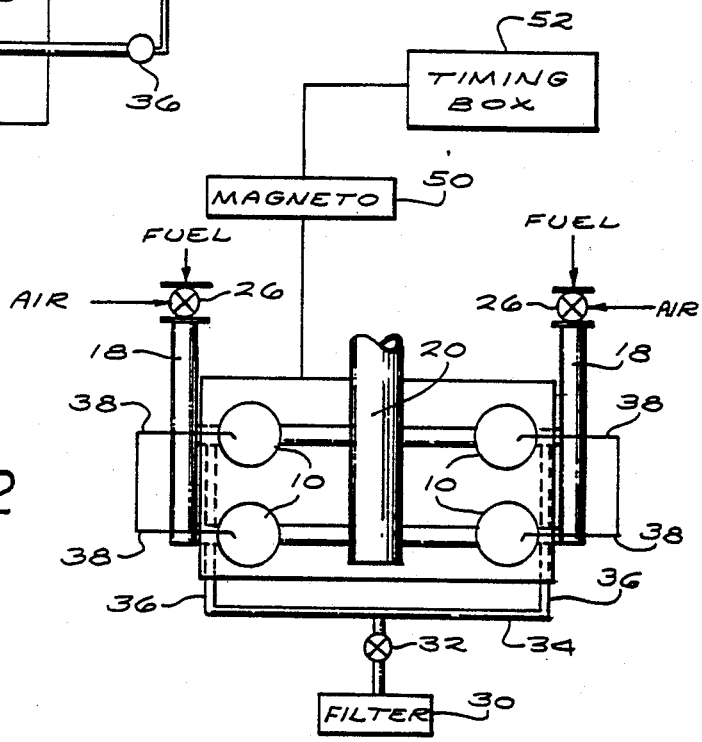
FIG. 2 is a schematic, plan view of the engine shown in FIG. 1.

In FIG. 2, the intake manifold is seen to be connected at its other end with a carbureting means 26 for supplying and determining the ratio of the fuel-air mixture to the cylinder 10. Connected with the cylinder is a spark plug 28 for igniting the fuel-air mixture that is supplied to the cylinder.

Figure 1:
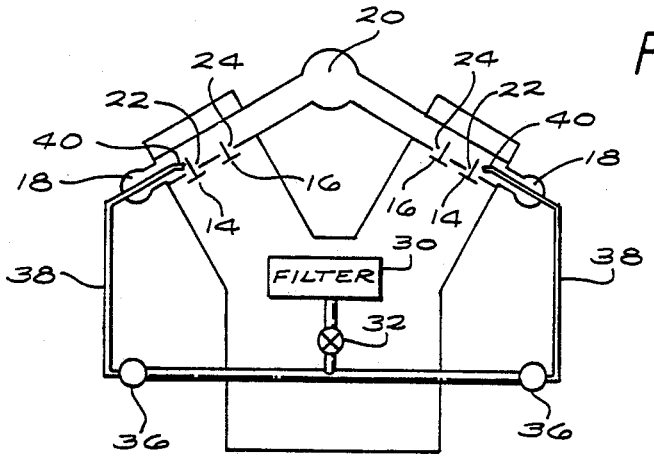
FIG. 1 is a schematic, sectional view of a digester gas engine incorporating the air injection means of the invention.

In accordance with the present invention, means are included for introducing, when the intake valve is closed, a quantity of air into the intake port or valve chamber 22, that is, the portion of the valve chamber which is adjacent the intake valve. In FIG. 1, the air-introducing means is seen to include an air intake filter 30 which delivers air at atmospheric pressure through an air control valve 32 into a conduit 34, and thereafter to air distribution manifolds 36 at either side of the engine. From the manifolds 36, a plurality of individual air delivery tubes 38 lead from the manifold 36 to deliver air to each intake port 22. In FIGS. 1 and 2, the delivery tubes 38 are seen to pass through the intake manifold 18, being sealed to the outer edge thereof by appropriate sealing means, not shown, and continue into the intake port 22 adjacent the intake valve 14.

In accordance with the present invention, the relative pressure difference between the atmospheric air and the fuel-air mixture in the manifold 18 is controlled, relative to the dimensions of the intake manifold, such that the air quantity formed in the intake port 22 is less than the displacement of the cylinder 10 whereby when the intake valve 14 is opened and the piston 12 completes the suction stroke, the quantity of air in the intake port forms a gradient air/fuel mixture which fills the chamber 10 to a level adjacent to and above the piston with an incombustible portion, the remaining portion of the cylinder 10 adjacent the spark plug 28 being filled with the air-fuel mixture having a gradually increasing air/fuel concentration supplied from the portion of the intake manifold above the intake port 22. The air flow is caused by the fact that the atmospheric air pressure within the air-introducing means and the delivery tubes 38 is in excess of the lower pressure within the intake manifold, caused by the suction strokes of the other pistons 12. Thus, when the intake valve 14 is closed, the atmospheric pressure in the air-introducing means will fill the intake port 22 with air. The tip 40 of the air delivery tube 38 is adjacent the intake valve 14 and is selected to have a size which is appropriate, with respect to the cylinder 10, to admit a volume of air which is sufficient to form a gradient charge in the cylinder as is described. The volume of the intake port 22 must also be sufficient to accommodate the necessary quantity of air. It is apparent that the intake port 22 and the tips 40 of the air delivery tubes may be fashioned or positioned so that the desired air/fuel distribution is achieved by simple modification apparent to one skilled in the art. For example, U.S. Pat. No. 2,729,205 to Nichols describes air injection into the zone adjacent the intake valve so that only air is present in that zone when the valve opens for scavenging, and FIG. 1 of U.S. Pat. No. 4,104,989 shows a similar air injection apparatus which may be adapted for use in the present invention even though the "pocket" of lean air/fuel mixture defined in that patent is not formed. The teachings of these patents are incorporated herein by reference.

During operation, a quantity of air, the terminus thereof indicated by the dotted line across the intake port 22 in FIG. 3, is drawn into the intake port adjacent the intake valve 14 by the manifold vacuum. The quantity of air is a function of the size of the tubing 38 and the tip 40, and the degree of vacuum present within the manifold. On opening of the intake valve 14, the quantity of air is drawn into the cylinder during the suction stroke to form a gradient of incombustible air/fuel mixture adjacent the piston, and the space adjacent the spark plug is subsequently filled by a fuel/air mixture having an increased fuel concentration which resides in the port and intake manifold upstream of the air pocket.

With respect to the sizing of the intake port 22 and the tip of the air delivery tubes 38, in the Ingersoll-Rand PKVG-10 engine, significant improvement in exhaust emissions was realized by the use of a stainless steel air injection tube having an internal diameter of 1.25 inches which was positioned within an intake port having an average diameter of 4.25 inches. The tip of the tube was positioned about two inches from the port side of the intake valve. The volume of air between the tip of the air delivery tube and the intake valve was about 24.5 cubic inches, as compared to a cylinder inlet manifold volume of about 234 cubic inches and a cylinder volume of about 3,300 cubic inches.

Returning now to FIG. 2, the internal combustion engine also includes a magneto 50 which provides spark-inducing voltage to the spark plugs 28 at a timing which is selected by a variable spark timing means 52. The spark timing means permits the manual adjustment of the spark timing advance for the engine, and also includes an automatic programmable timing means such as a programmable microprocessor that automatically produces a desired spark angle for any given engine speed. Such devices are wellknown in the art, and a particularly advantageous unit is a self-powered, low tension, capacitor discharge ignition system for industrial engines manufactured by the Altronics Corporation of Girard, Ohio and sold under the trade name Altronic III. Other automatic electronic spark angle advance devices which may-be employed are manufactured by the Bendix Corporation, American Bosch and Fairbanks Corporation.

The calibration of the engine for minimizing exhaust emissions is undertaken by first selecting a constant engine speed within the operating range of the engine. For example, the primary effluent pump station Ingersoll-Rand-PKVG-10 engines have an operating range of from 200–300 RPM in normal operation, and occasionally exceed this range up to 330 RPM under storm-flow conditions. Accordingly, a constant engine speed of 260 RPM was selected. The spark timing angle was then manually adjusted to 19° before top dead center ("BTDC") from the normal operating advance. At this point, the air control valve 32 was closed, and no air was being injected into the combustion chambers.

Under these conditions, the carbureting means 26 were then adjusted, individually, so that the oxygen content of the exhaust gas was about 1.60% by volume while the manifold vacuum was in the range of from 10.0 inches to 12.5 inches Hg. The selection of the particular manifold vacuum is not critical to the calibration method, and any vacuum in excess of the stall point of the engine, in this instance 3.0 inches Hg minimum, can be maintained.

Thereafter, the air injection control valve 32 was adjusted to obtain minimum nitrogen oxide and carbon monoxide levels in the exhaust gas, while maintaining a minimum manifold vacuum of 3 inches Hg. After this adjustment, the engine speed was increased by 20 RPM increments up to 300 RPM, and at each such increase the spark advance was advanced from 19° BTDC to determine the spark angle that provided the minimum nitrogen oxide emissions. At each increment, nitrogen oxide and carbon monoxide emissions were noted to be in compliance with governmental regulations, in this instance, the limitations imposed by the Southern California Air Quality Management District Rule 1110.1 for rich burn engines fueled by digester gas. In several instances with different engines, variations in the nitrogen oxide and carbon monoxide levels were noted at one or more of the incremental engine speeds, and further adjustment of the air injection valve may be required. While not all engines will require such adjustment of the air injection control valve 32, if the emission levels exceed regulations, the amount of adjustment can be duly noted and manual adjustments made at that particular engine speed, or the air injection control valve can be automated by means which are known in the art.

The engine speed was then decreased from 260 RPM by 20 RPM increments down to 200 RPM, i.e., over the operating range of the engine. At each such speed increment, the spark angle was retarded from 19° BTDC to determine the spark angle that provided the minimum nitrogen oxide and carbon monoxide emissions. While these adjustments were made, the minimum manifold vacuum of 3.0 inches Hg was maintained. The spark advance for each incremental speed was recorded, and the data for engine #5 is shown in Table I and FIG. 4.

The particular engines involved in this testing are employed to operate primary effluent pump stations, that is, the pump which transports treated effluent into the environment. The engine may thus be occasionally subject to storm-flow conditions which require a significant increase of engine speed to as high as 330 RPM. In this instance, it has been found that a spark angle advance of to as much as 24 or 25° BTDC is required. Under these extreme conditions, the carbureting means may also have to be adjusted to increase the fuel-air ratio to maximum $NO_x$ output without air injection, and the air injection valve then opened sufficiently to obtain at least an 80% decrease in nitrogen oxide while maintaining the minimum manifold vacuum of 3.0 inches Hg.

Figure 4:
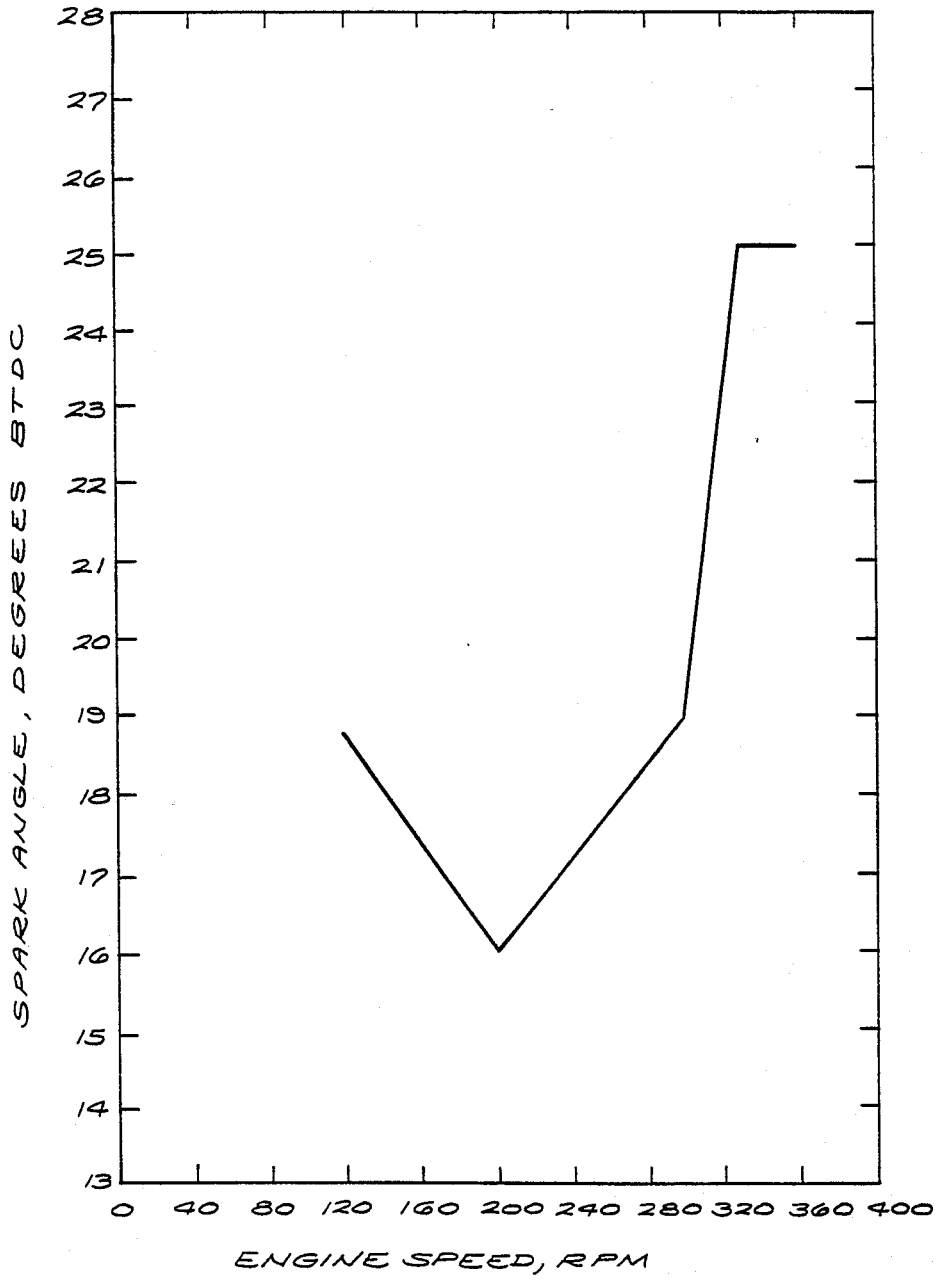
FIG. 4 is a graph of the advantageous spark advance curve for a digester gas engine.

From this description it will be apparent that significantly advantageous emissions are obtained from the use of a spark advance curve shown in FIG. 4, that is a curve which increases essentially monotonically from about 16 degrees advance at 200 RPM, to 17.2 degrees at 240 RPM, 18.4 degrees at 280 RPM and 19 degrees at 300 RPM, i.e., over the operating range of the engine. Under ten-year storm conditions, this curve can be extended to include an advance of 25 degrees at 330 RPM.

Figure 5:
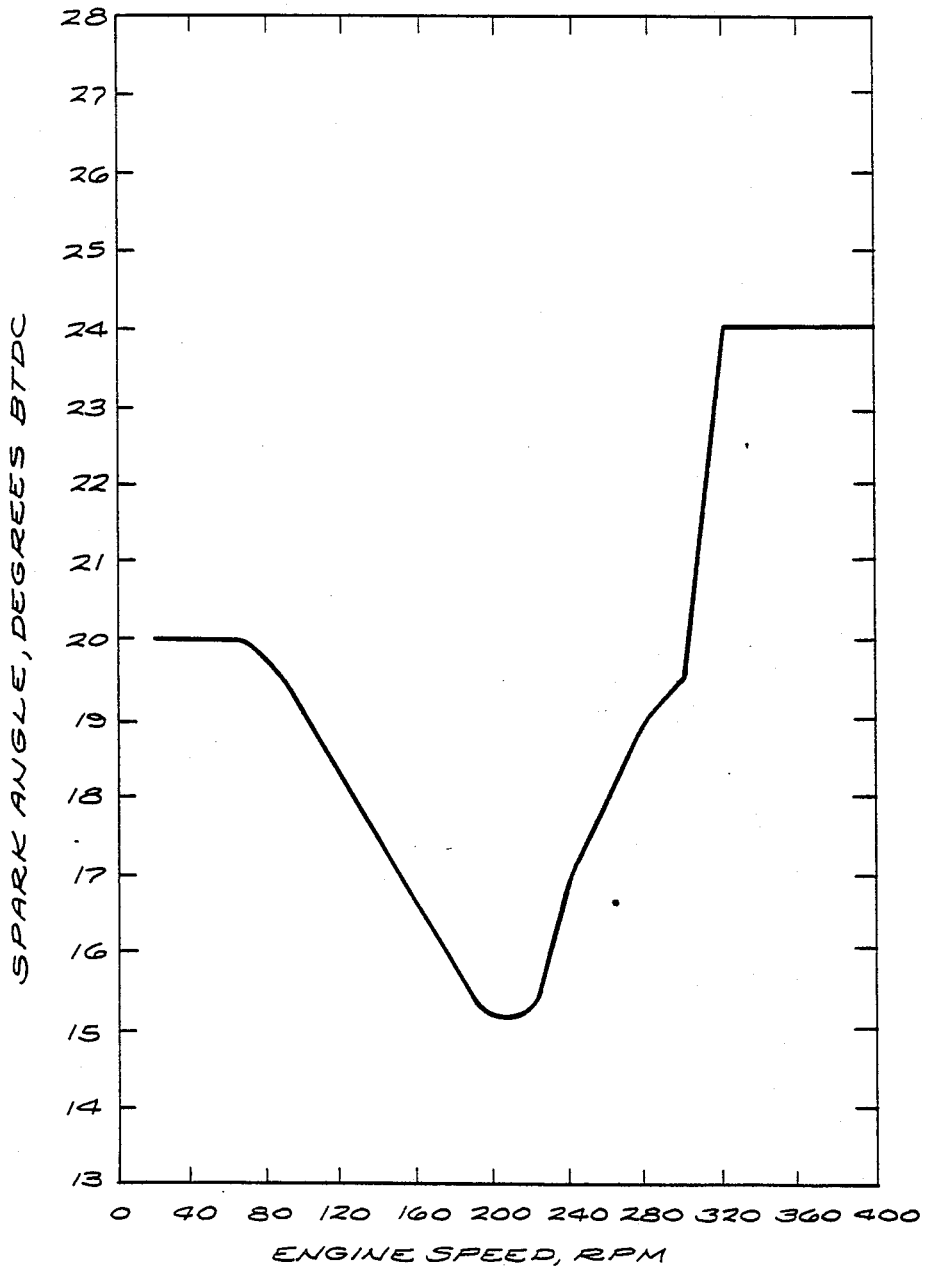
FIG. 5 is a graph of the advantageous spark advance curve for a second digester gas engine.

An essentially identical calibration method was performed on primary effluent pump station engine #1, and similar results were obtained, as is shown in Table I and FIG. 5. The spark advance curve in FIG. 5 is seen to increase in an essentially monotonical manner (i.e., uniformly without significant variance) from about 15.2 degrees advance at 200 RPM, to 17.0 degrees at 240 RPM, 19.0 degrees at 280 RPM and 19.5 degrees at 300 RPM (over the operating range of the engine).

If it is not possible to meet the emission limits, particularly at lower engine speeds, the procedure has been repeated by adjusting the initial spark angle to 18.5° BTDC and adjusting the carbureting means of both banks of cylinders to achieve about 1.50% oxygen in the exhaust gas without air injection. The remaining steps are then completed as described. With respect to higher engine speeds (usually above 300 RPM), it has been found that an increase in spark advance to about 20° to 25° BTDC is required.

Upon successful calibration of the engine over the entire range of operating speeds, the data prepared with respect to spark advance is used to prepare a graph (engine speed versus spark angle) which is then employed, usually by the equipment manufacturer, to program the spark timing means 52 to automatically advance or retard the timing angle in reponse to changes in engine speed. By developing the optimal spark timing angle over a range of operating speeds, and determining the carburetion and air injection settings on the engine as described, both the nitrogen oxide and carbon dioxide emissions of the rich-burn engines fueled by digester gas are vastly improved and have been found to be in compliance with the Southern California Air Quality Management District Rule 1110.1 ($NO_x$, 90 PPM at 15% $O_2$; CO, 0.20% at 15% $O_2$). The mixing valve setting (carburetion) is constant, the air injection valve opening range is either constant or may be slightly varied, and the spark angle automatically variable for all engine speeds, from idling (200 RPM) to the maximum dry weather flow engine speed of 300 RPM. Under storm flow conditions (which occur very infrequently) that require the engines to be operated at 330 RPM, a special carburetion setting is found at an increased spark advance along with a specific adjustment in the air injection control valve. This mixing and air control valve adjustment, and other adjustments of these controls which must be made in accordance with particular needs under the invention, take only a few seconds to accomplish.

The reduction of nitrogen oxide emission is achieved by lowering the combustion temperature through air injection into the power cylinders where the leaner air/fuel mixture adjacent the piston acts as a heat sink, and due to the retarded spark angle (i.e., less than the maximum of 25° BTDC) which prevents the cylinder charge from being exposed to the spark for a longer time. There is also a significant reduction in carbon monoxide emissions at lower engine speeds (200–260 RPM) which is due solely to the improved air/fuel mixing achieved by the described air injection apparatus and method, which leads to an increase of complete combustion of the digester gas to carbon dioxide and water. The most dramatic improvement occurs at 200 RPM where, prior to the use of air injection up to 22.5% of the fuel's methane oxidized to carbon monoxide, and after activation of the air injection only about 2.8% of the methane was oxidized to carbon monoxide. As is shown in Table I, lines one through eight, and Table II, lines one through four, significant reduction of CO emissions is obtained solely by the described injection of air into the intake port while the spark advance remains essentially unchanged. An additional benefit of the invention is the reduction of the fuel consumption by about 6% by weight due to the decrease in manifold vacuum which draws the fuel into the engine, i.e., the displacement of the air/fuel charge by injected air.

The invention may be adapted to any stationary, naturally aspirated reciprocating engine fueled by gaseous fuel for the purpose of nitrogen oxide and carbon monoxide emission control, and has been shown to be significantly beneficial to such engines which are fueled by digester gas. The foregoing description of the invention has been directed to a particular preferred embodiment for the purpose of explanation. It will be apparent, however, to those of ordinary skill in the art that many modifications and changes both in the apparatus and the method may be made without departing from the scope and spirit of the invention.

TABLE I

PRIMARY EFFLUENT PUMP STATION ENGINE #5
EXHAUST EMISSIONS AND PERFORMANCE

| Engine Speed (RPM) | Spark Setting (°BTDC | Avg. Manifold Vacuum (Inch Hg) | Air Injection Valve Opening 0 = Closed Fully 9 = Opened | Exhaust Gases, Dry @ STP $O_2$ (%) | $CH_4$ (%) | $CO_2$ (%) | Actual CO (%) | Actual $NO_x$ (PPM) | Corrected to 15% $O_2$ CO (%) | Corrected to 15% $O_2$ $NO_x$ (PPM) |
|---|---|---|---|---|---|---|---|---|---|---|
| 198 | 16.0 | 16.3 | 0 | 4.11 | 1.56 | 13.00 | 2.39 | 63 | 0.84 | 22 |
| 206 | 16.0 | 16.5 | 1.75 | 4.14 | 1.07 | 13.81 | 0.28 | 270 | 0.10 | 95* |
| 220 | 16.5 | 16.0 | 0 | 3.81 | 1.17 | 13.68 | 1.36 | 245 | 0.47 | 85 |
| 220 | 16.5 | 14.8 | 2.20 | 6.34 | 0.65 | 12.48 | 0.01 | 230 | <0.01 | 93* |
| 240 | 17.0 | 14.8 | 0 | 3.75 | 1.04 | 14.24 | 0.91 | 400 | 0.31 | 138 |
| 240 | 17.0 | 13.2 | 2.30 | 6.88 | 0.89 | 11.60 | 0.02 | 190 | 0.01 | 80 |
| 260 | 17.5 | 13.1 | 0 | 3.25 | 1.02 | 14.40 | 0.44 | 520 | 0.15 | 174 |
| 260 | 17.5 | 11.7 | 2.20 | 6.10 | 0.91 | 12.05 | 0.03 | 215 | 0.01 | 86 |
| 280 | 18.0 | 10.0 | 0 | 3.76 | 1.01 | 14.20 | 0.06 | 780 | 0.02 | 268 |
| 280 | 18.0 | 9.8 | 2.60 | 6.52 | 0.80 | 11.79 | 0.04 | 225 | 0.02 | 92* |
| 300 | 19.0 | 7.5 | 0 | 4.71 | 0.91 | 13.52 | 0.07 | 950 | 0.03 | 346 |
| 300 | 19.0 | 6.1 | 2.60 | 7.16 | 0.78 | 11.51 | 0.04 | 200 | 0.02 | 86 |

*Could be reduced to 90 PPM by further opening of the air injection valve.

TABLE II

PRIMARY EFFLUENT PUMP STATION ENGINE #1
EXHAUST EMISSIONS AND PERFORMANCE

| Engine Speed (RPM) | Spark Setting (°BTDC) | Avg. Manifold Vacuum (Inch Hg) | Air injection Valve Opening 0 = Closed Fully 9 = Opened | Exhaust Gases, Dry @ STP $O_2$ (%) | $CH_4$ (%) | $CO_2$ (%) | Actual CO (%) | Actual $NO_x$ (PPM) | Corrected to 15% $O_2$ CO (%) | Corrected to 15% $O_2$ $NO_x$ (PPM) |
|---|---|---|---|---|---|---|---|---|---|---|
| 200 | 15.3 | 16.0 | 0 | 0.22 | | | 1.40 | 195 | 0.40 | 56 |
| 200 | 15.3 | 11.7 | 2.0 | 7.20 | | | 0.22 | 200 | 0.09 | 86 |
| 220 | 15.6 | 15.4 | 0 | 0.22 | | | 0.80 | 410 | 0.23 | 117 |
| 220 | 15.6 | 12.1 | 2.0 | 5.60 | | | 0.04 | 225 | 0.02 | 87 |
| 240 | 17.0 | 14.8 | 0 | 0.48 | | | 0.05 | 670 | 0.01 | 194 |
| 240 | 17.0 | 9.1 | 2.3 | 7.00 | | | 0.04 | 200 | 0.02 | 85 |
| 260 | 18.5 | 12.7 | 0 | 1.52 | | | 0.04 | 840 | 0.01 | 256 |
| 260 | 18.5 | 8.2 | 2.3 | 6.80 | | | 0.04 | 215 | 0.02 | 90 |
| 280 | 19.0 | 10.5 | 0 | 2.10 | | | 0.04 | 810 | 0.01 | 254 |
| 280 | 19.0 | 7.2 | 2.3 | 6.00 | | | 0.03 | 200 | 0.01 | 79 |
| 300 | 20.5 | 8.0. | 0 | 2.62 | | | 0.04 | 800 | 0.01 | 258 |
| 300 | 20.5 | 5.0 | 3.0 | 6.10 | | | 0.04 | 205 | 0.02 | 82 |
| 330 | 24.0 | 7.5 | 0 | 1.90 | | | 0.04 | 1,620 | 0.01 | 503 |
| 330 | 24.0 | 3.8 | 9.0 | 5.90 | | | 0.04 | 500 | 0.02 | 197 |

I claim:

1. A method for controlling nitrogen oxide emissions in the exhaust gas of a spark-ignition, Otto cycle internal combustion engine including:

(A) at least one combustion chamber formed by a piston and a cylinder having intake and outlet valves;

(B) intake manifold means for delivering a charge of fuel-air mixture through the intake valve to the combustion chamber;

(C) mixing means connected to the intake manifold means and disposed upstream with respect to the intake valve for controlling the ratio of the fuel-air mixture;

(D) spark ignition means for igniting the charge in the combustion chamber; and (E) spark timing means for advancing or retarding the timing of the ignition of the charge with respect to the position of the cylinder in the Otto cycle, the timing means being programmable to allow the timing to be varied with respect to incremental alterations in engine speed;

the method comprising the steps of:

(1) setting the engine to operate at a given engine speed within the operating range of the engine;

(2) adjusting the spark timing to obtain a desired nitrogen oxide emission at that speed;

(3) recording the required spark timing to obtain t desired nitrogen oxide emission at the speed;

(4) repeating the above steps of setting, adjusting and recording over a plurality of engine operating speeds; and (5) programming the spark timing means based on the data recorded to produce the required spark timing for any given engine speed.

2. The method of claim 1 wherein the steps of setting, adjusting and recording are repeated at incremental speeds over the normal operating range of said engine.

3. The method of claim 1 wherein the steps of setting, adjusting and recording are repeated at incremental speeds over the operating range of said engine.

4. The method of claim 1 further comprising the step of preparing a spark timing curve based on the data obtained from said repeating step and wherein said programming of the spark timing means is based on said spark timing curve.

5. The method of claim 1 further comprising the step of adjusting the mixing means to reduce nitrogen oxide emissions.

6. The method of claim 1 wherein said adjusting of the spark timing is performed to obtain the minimum nitrogen oxide emission at said speed.

7. A method for controlling emissions in the exhaust gas of a spark-ignition, Otto cycle internal combustion engine including:

(A) at least one combustion chamber formed by a piston and a cylinder having intake and outlet valves;

(B) intake manifold means for delivering a charge of fuel-air mixture through the intake valve to the combustion chamber;

(C) mixing means connected to the intake manifold means and disposed upstream with respect to the intake valve for controlling the ratio of the fuel-air mixture;

(D) an air delivery means communicating with said intake manifold means and adjacent the upstream side of the intake valve;

(E) air control means adapted to permit the adjustment of the amount of air delivered through the air delivery means;

(F) spark ignition means for igniting the charge in the combustion chamber; and (G) spark timing means for advancing or retarding the timing of the ignition of the charge with respect to the position of the cylinder in the Otto cycle, the timing means being programmable to allow the timing to be varied with respect to incremental alterations in engine speed;

the method comprising the steps of:

(1) setting the engine to operate at a given engine speed within the operating range of the engine;

(2) adjusting the spark timing to obtain a desired nitrogen oxide emission at that speed;

(3) recording the required spark timing to obtain the desired nitrogen oxide emission at the speed;

(4) repeating the above steps of setting, adjusting and recording over a plurality of engine operating speeds; and (5) programming the spark timing means based on the data recorded to produce the required spark timing for any given engine speed.

8. The method of claim 7 further comprising the additional steps of retarding the spark timing means from the optimal tuning angle, regulating the mixing means to obtain a desired oxygen level in the exhaust gas, opening the air control means and adjusting the amount of air delivered through the air delivery means to reduce nitrogen oxide and carbon monoxide emissions in the exhaust gas, all of said additional steps occurring prior to adjusting the spark timing.

9. The method of claim 8 wherein said adjusting of the spark timing is performed to reduce the nitrogen oxide emission at said speed.

10. The method of claim 8 wherein said adjusting of the spark timing is performed to obtain the minimum nitrogen oxide emission at said speed.

11. The method of claim 8 further comprising the step of adjusting the air control means to reduce nitrogen oxide emissions at a plurality of engine operating speeds

12. The method of claim 11 further comprising the step of programming the air control means to make the required adjustment to reduce nitrogen oxide emissions for any of said plurality of engine speeds.

13. The method of claim 7 wherein the engine is operated on gaseous fuel.

14. The method of claim 7 wherein the engine is operated on digester gas.

15. The method of claim 14 wherein the spark timing means is programmed to produce a spark angle of about 15.2 16 degrees at 200 RPM, 17.0 to 17.2 degrees at 240 RPM, 18.4 to 19 degrees at 280 RPM and 19 to 19.5 degrees at 300 RPM.

16. A gaseous fueled Otto cycle internal combustion engine comprising:

(1) at least one combustion chamber formed by a piston and a cylinder having intake and outlet valves;

(2) intake manifold means for delivering a charge of fuel-air mixture through the intake valve to the combustion chamber;

(3) mixing means connected to the intake manifold means and disposed upstream with respect to the intake valve for controlling the ratio of the fuel-air mixture;

(4) spark ignition means for igniting the charge in the combustion chamber;

(5) an air delivery means communicating with said intake manifold means and adjacent the upstream side of the intake valve;

(6) air control means adapted to permit the adjustment of the amount of air delivered through the air delivery means;

(7) spark timing means for advancing or retarding the timing of the ignition of the charge with respect to the position of the cylinder in the Otto cycle; and (8) automatic programmable timing means for programming the spark timing means to vary the timing with respect to incremental alterations in engine speed to reduce nitrogen oxide emissions in the exhaust gas of the engine.

* * * * *

UNITED STATES PATENT AND TRADEMARK OFFICE

CERTIFICATE OF CORRECTION

PATENT NO. : 4,901,698

DATED : February 20, 1990

INVENTOR(S) : Vladimir A. Novy

It is certified that error appears in the above-identified patent and that said Letters Patent is hereby corrected as shown below:

Column 6, line 25, delete "I" and substitute therefor --II--.

Column 6, line 48, delete "reponse" and substitute therefor --response--.

Column 9, line 18, after "obtain" delete "t" and substitute therefor --the--.

Signed and Sealed this

Second Day of October, 1990

*Attest:*

HARRY F. MANBECK, JR.

*Attesting Officer*

*Commissioner of Patents and Trademarks*